United States Patent [19]

Perren

[11] 4,022,687

[45] May 10, 1977

[54] METHOD FOR THE NON-MECHANICAL CONVEYING OF A COLLECTED QUANTITY OF LIQUID AND APPARATUS FOR THE PERFORMANCE OF THE METHOD

[76] Inventor: Benno Perren, Austrasse 33, 5430 Wettingen, Switzerland

[22] Filed: Mar. 21, 1975

[21] Appl. No.: 560,683

[30] Foreign Application Priority Data

Mar. 28, 1974 Switzerland ..... 4383/74

[52] U.S. Cl. ..... 210/65; 210/DIG. 25; 137/154; 137/1

[51] Int. Cl.[2] ..... E02B 15/04

[58] Field of Search ..... 137/154, 453, 1; 417/150; 210/DIG. 25, 242 S, 65

[56] References Cited

UNITED STATES PATENTS

| | | | |
|---|---|---|---|
| 652,375 | 6/1900 | Snell | 137/154 |
| 2,746,253 | 5/1956 | Anderson | 137/453 X |
| 3,944,489 | 3/1976 | Derzhavets | 210/DIG. 25 |
| 3,983,034 | 9/1976 | Welson | 210/DIG. 25 |

*Primary Examiner*—Alan Cohan
*Attorney, Agent, or Firm*—Werner W. Kleeman

[57] ABSTRACT

A method of, and apparatus for, the non-mechanical conveying of a collected quantity of liquid from a lower level to a higher level wherein through freeing of flow paths a quantity of a heavier liquid located at the higher level flows to the lower level and while utilizing the different specific gravities of both liquids there is conveyed an at least approximately equal volumetric quantity of the lighter liquid to be conveyed to the higher level.

The apparatus for the performance of the aforesaid method aspects embodies a container located at the higher level and which is filled with the heavier liquid, this container being in flow communication with the lighter liquid located at the lower level.

5 Claims, 6 Drawing Figures

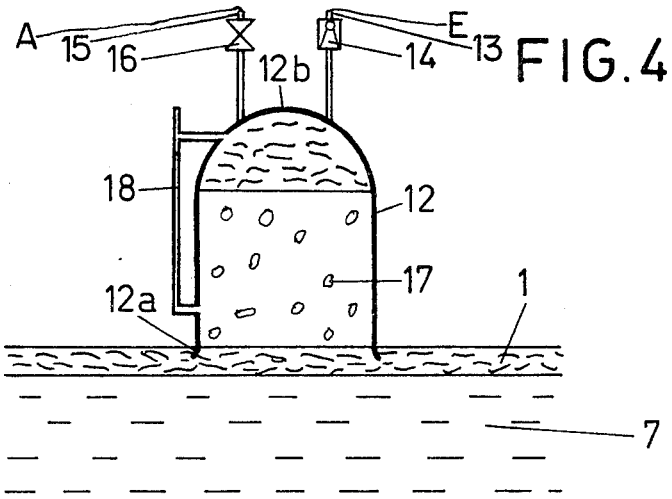
FIG. 4
FIG. 5
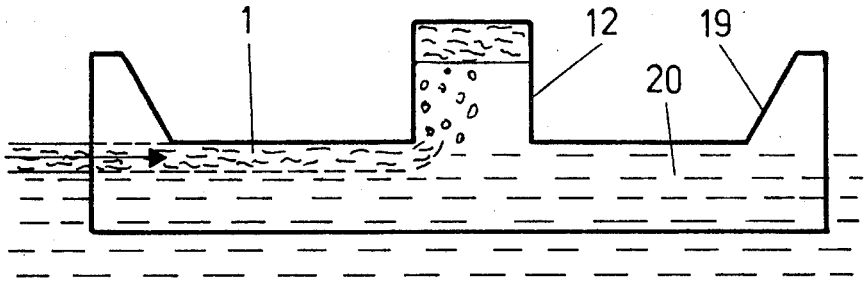
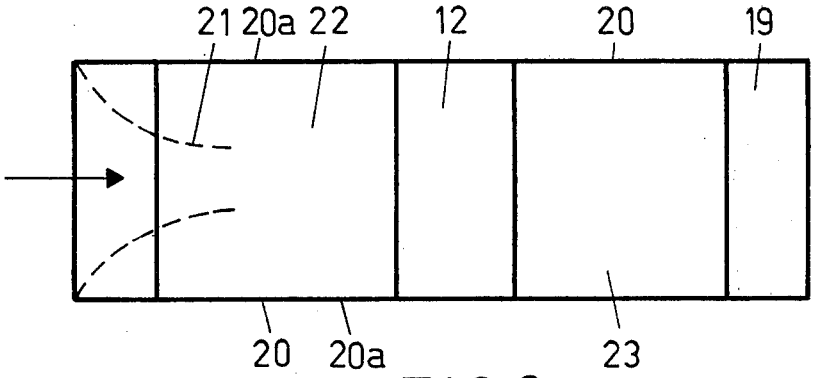
FIG. 6

METHOD FOR THE NON-MECHANICAL CONVEYING OF A COLLECTED QUANTITY OF LIQUID AND APPARATUS FOR THE PERFORMANCE OF THE METHOD

BACKGROUND OF THE INVENTION

The present invention relates to a new and improved method for the non-mechanical conveying of a collected quantity of a liquid from a lower level to a higher level and further pertains to a new and improved construction of apparatus for the performance of the aforesaid method.

In the context of this disclosure the expression "non-mechanical conveying" as used in connection with the conveying of the collected quantity of liquid from the lower level to a higher level is intended to indicate that there are not employed standard pieces of equipment or machinery such as conveying pumps or other heretofore utilized liquid conveying machinery or equipment.

Conveying of liquid from a lower to a higher level generally requires the use of pressure pumps. If there is present a closed container in which there is housed the liquid, then for instance it is possible to pump such liquid within the container to a higher level by increasing the pressure of the air located above the liquid level. When the desired conveying height is not too great then it is possible to also use a suction pump. With all these conveying techniques there are required liquid conveying machinery and generally also electrical energy.

SUMMARY OF THE INVENTION

Hence, it is a primary object of the present invention to provide an improved method of, and apparatus for, conveying a collected quantity of liquid from a lower level to a higher level without resorting to the aid of mechanical devices or equipment.

Yet a further object of the invention aims at a novel method of, and apparatus for, reliably an positively conveying a quantity of liquid from a lower level to a higher level in an efficient, simple and inexpensive manner.

Another object of this invention aims at the provision of apparatus for conveying liquid from a lower level to a higher level without the need to resort to conventional liquid-conveying equipment and wherein the apparatus of this development is relatively simple in construction and design, economical to manufacture, relatively easy to use, extremely reliable in operation, and requires a minimum of maintenance and servicing.

Now in order to implement these and still further objects of the invention, which will become more readily apparent as the description proceeds, the method aspects of this development reside in the features that by freeing flow paths a quantity of a heavier liquid located at the higher level flows to the lower level and while utilizing the different specific gravities of both liquids there is conveyed at least approximately the same volumetric quantity of the lighter liquid which is to be conveyed to the higher level.

As indicated above the invention is not only concerned with the aforementioned method facets, but also relates to a novel construction of apparatus for the performance of the aforesaid method, which apparatus is manifested by the features that there is provided a container at the higher level, this container is filled with the heavier liquid and is in flow commmunication with the lighter liquid located at the lower level.

Equipment for the performance of the method of this invention is both relatively simple in construction and inexpensive. It does not require any continuously moving or rotating parts, rather only the preparatory positioning of the heavier liquid at the higher level. The equipment or apparatus of the invention can be placed into operation without any further preparatory work. Only if there is intended to be provided an automatic regulation is there necessary a current connection. By placing a number of apparatuses embodying the features of the invention in a row above one another i.e. in superimposed fashion, it is possible to also overcome greater conveying heights.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 4 illustrates the construction of a still further embodiment of apparatus according to the invention;

FIG. 5 is a longitudinal sectional view portraying the use of the apparatus of FIG. 4; and FIG. 6 is a top plan view of the apparatus of FIG. 5.

DETAILED DESCRIPTION OF THE INVENTION

Figure 1:
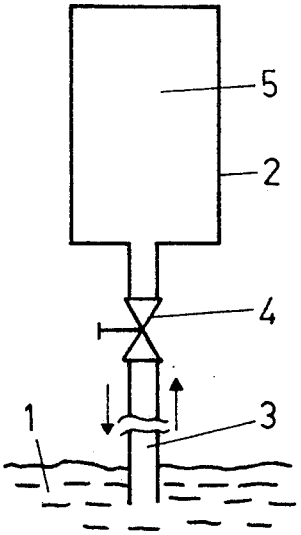
FIG. 1 schematically illustrates a first exemplary embodiment of apparatus for the performance of the method aspects of this development.

Referring now to the drawings, it is to be understood that throughout the various Figures there have been generally employed the same reference characters for the same components. Turning attention therefore to the exemplary embodiment of apparatus shown in FIG. 1, it will be seen that a closed container 2 is arranged above the collected quantity of liquid 1 which is to be conveyed to a higher level. At the lowest point of the container 2 there is connected the pipe or conduit 3. Conduit 3 extends to a location where it is immersed in the liquid 1 and can be closed by means of a suitable throttle element 4, for instance constituted by a throughpass or two-way valve. The container 2 is filled with a liquid 5, the specific gravity of which is greater than that of the liquid 1. By way of example, the heavier liquid and the lighter liquid can be water and an organic liquid, such as for instance oil; for the sake of simplicity in the disclosure there will be assumed hereinafter that water and oil are such liquids which are employed, although it is to be expressly understood that the invention is in no way intended to be limited to these exemplary types of liquids.

Continuing, for the purpose of placing the system into operation it is sufficient to simply open the throttle element 4. Consequently, the water flows down to the lower level, but only to the extent that oil upwardly ascends in consequence of the negative pressure which prevails in the container and by virtue of the lift of the oil in water. Both of these flow directions in the conduit or pipe 3 have been schematically portrayed by the arrows which have not been particularly provided with a reference character. A certain amount of time is needed until the container 2 is filled with oil. The time required for this purpose is dependent in the first instance upon the volume of the container 2, but furthermore also upon the cross-sectional area of the pipe or conduit 3 and upon the magnitude of the difference of the specific gravities of both liquids. The narrower the conduit 3 i.e., the smaller the cross-sectional area thereof, the greater is the mutual disturbance of the liquids which are flowing in opposite directions with regard to one another. Also the lighter that the one liquid is in relationship to the other that much more quickly will the lighter liquid ascend.

If the air is neglected which, for instance, may be present in the pipe or conduit 3 below the throttle element 4 and which of course upwardly ascends, then approximately the same volume of oil will be conveyed to the higher level as the volume of water which flows to the lower level.

The permissible length of the conduit 3 is limited and therefore also the possible conveying height. The conduit 3 must be shorter than the theoretical suction height of water and oil, respectively, because otherwise the liquid column will break apart and the conveying action interrupted.

Furthermore, it should be readily apparent that when using a larger size container it would be possible to also provide a number of conduits or pipes 3.

Figure 2:
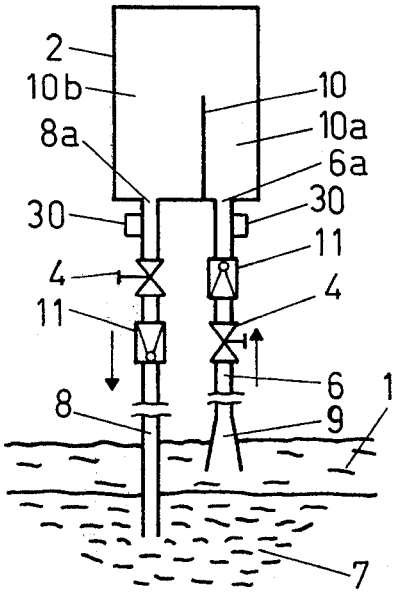
FIG. 2 schematically illustrates a second embodiment of inventive apparatus.

In FIG. 2 there is illustrated a different embodiment of the invention. Once again the container 2 is filled with water by way of example, but the flow paths of both liquids are separated from one another. The first conduit or pipe 6 with the throttle element 4 is contemplated for conveying the oil 1 which in this case floats upon the liquid 7. Liquid 7 however need not be identical with the liquid contained in the container 2. the conduit 6 terminates in the layer of oil 1 as shown. To permit the downward flow of the water out of the container there is provided the second conduit or pipe 8 which likewise possesses a throttle value 4 and in this exemplary embodiment terminates in the liquid 7, as shown.

If both throttle elements 4 are opened, then the water flows downwardly and —practically starting at the same time—the oil flows upwardly, as such has been schematically indicated by the arrows. Both of the conduits 6 and 8 thus function in the manner of communicating pipes. The flow is much more rapid than is the case for the embodiment of FIG. 1, because in no one of the conduits does the one liquid flow contra the other liquid. It is of advantage if the conduits 6 and 8 at least approximately open at the lowest point of the container 2 and the mouth openings 6*a* and 8*a* of the conduits 6 and 8 respectively are separated from one another by a wall or partition 10 which permits a flow communication of the container regions or portions 10*a* and 10*b* with one another.

By virtue of these measures both of the liquids are least commingled with one another within the confines of the container 2, and there is extensively eliminated the possibility that oil will again be entrained by the water which flows downwardly through the conduit or pipe 8 and the container 2 can be practically completely emptied of the water, so that its capacity is most fully utilized. In order to balance or compensate the flow operations it is advantageous if both conduits possess at least approximately the same cross-sectional area.

If the oil layer is only thin, then the suction action through a standard conduit can cause difficulties. In this case it is advantageous if the lowermost portion 9 of the conduit 6 is widened in a funnel-like manner. Furthermore, it is advantageous in all instances if at least the lowermost portion of the conduit which terminates in the lighter liquid consists of a material which possesses a greater moistening power or capability for the lighter liquid than for the heavier liquid.

It is not an absolute precondition where the second conduit 8 must terminate. With the embodiment of FIG. 2 the prevailing conditions are very simple and the illustrated arrangement has been found to be most advantageous. Both in this example, as well as when no liquid is present beneath the oil which is to be conveyed, the conduit 8 can lead up to the base or floor of the collection of liquid, but however it also can terminate at the same height as the first conduit 6 or even above the liquid level.

In order to facilitate the formation of the desired flow in both conduits in the case of borderline or critical conditions, it is advantageous if initially there begins to open the throttle elements 4 of the second conduit 8 and then after a certain time-delay there begins to open the throttle element 4 of the first conduit 6. It can even be advantageous to first then begin with the opening of the throttle element of the first conduit 6 when the throttle element of the second conduit 8 has already been completely opened. Such regulation or control operations can be carried out manually or automatically. Furthermore, in both of the conduits 6 and 8 there can be arranged a respective nonreturn or check valve 11, rendering possible a clear definition of the flow direction.

In order to control the flow it is possible to arrange flow monitors in the conduits, as schematically illustrated by the flow monitor 30 shown in FIG. 2. Generally, a single flow monitor is sufficient which is preferably installed in the second conduit 8. It can advantageously be also utilized for regulation purposes in that it, for instance, closes the throttle elements of both conduits when it no longer determines any flow or delivers an alarm signal.

Figure 3:
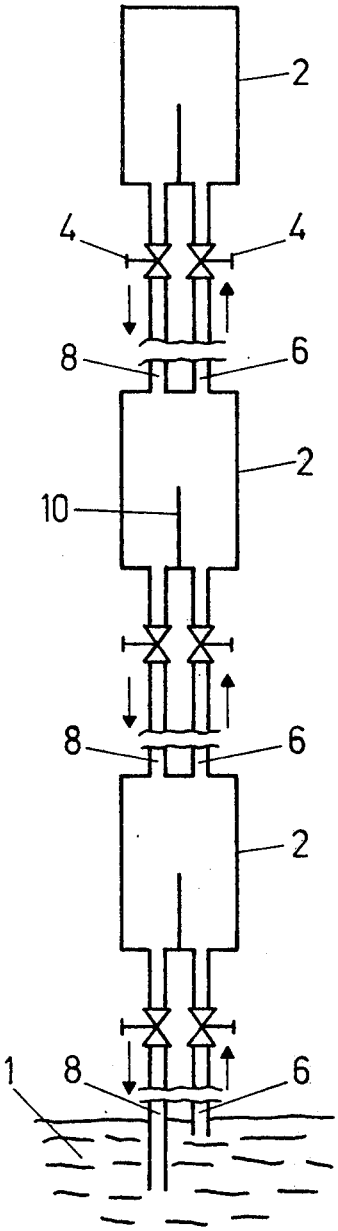
FIG. 3 illustrates a combination of a number of the apparatuses shown in FIG. 2 arranged in a row above one another.

FIG. 3 illustrates an arrangement of three containers 2 one above the other, rendering possible an infinite conveying of the oil to a greater level. These containers 2 are of the type shown in FIG. 2, but for the sake of simplifying the illustration the flow monitors 30 have been omitted although each such container could be equipped with such flow monitor or monitors as previously discussed. Each container 2 will be seen to again incorporate the first conduit 6 and the second conduit 8, both conduits leading downwardly and being capable of being shut-off or closed by the throttle elements 4. Both conduits of the lowermost container 2 extend downwardly into the oil 1 which is to be conveyed. Both of the conduits 6 and 8 of the remaining containers 2 are sealingly connected in each instance with the container which is directly located therebeneath.

This combination and array of containers is comparatively possible between two neighboring containers of the type illustrated in FIG. 1 wherein each container only possesses one connecting conduit or pipe 3. The conduit 3 then advantageously opens into the lowermost point of the next upper situated container and at the highest point of the next lower situated container.

At the start of the conveying operation all of the containers are filled with water. The throttle or flow control elements in the conduits (or throttle element, if in each instance there is provided only one conduit) of the second container—calculated from below, i.e. the second container above the liquid 1— is first then opened when there has been completed the conveying of the oil into the first container. If during the course of the conveying operation the oil is located in the second container, then the throttle elements (or throttle element) of the third container are opened. Hence, the oil is upwardly conveyed from one stage to the next stage, and this conveying operation can be either initiated manually or carried out automatically.

Also in this instance the provision of a flow monitor, such as the flow monitor 30 shown in FIG. 2, can be extremely advantageous, and which then not only closes the throttle elements of the one container as soon as it determines that there is no longer any flow in its conduit, rather also delivers a control pulse for opening the throttle elements of the container located directly thereabove.

There is still possible, however, a further regulation or control. During the time that the oil ascends from the second container into the third container water can already be conveyed again into the lowermost container. If this possibility is faithfully employed, then during a first time-interval the throttle elements in the conduits of the first, third, fifth and so forth containers —again calculated or numbered in sequence from the bottom towards the top— are opened, whereas the remaining throttle elements are closed, and during a second time-interval the throttle elements in the conduits of the second, fourth and so forth containers are opened, whereas the throttle elements which were opened in the first time-interval are now closed. In other words, during one time-interval the throttle elements of the odd numbered containers are opened and during the second time-interval the throttle elements of the even numbered containers are opened. In this way there can be realized an extremely rational, semi-continuous conveying action.

The described apparatuses can be especially used there where there is only available a limited amount of space and the oil layer has a certain thickness. However, if one is dealing with a larger water surface, then the oil layer generally has a lesser thickness or in fact even forms a film upon the water surface. In those instances there is employed to advantage a different constructional embodiment of the apparatus which will be described more fully hereinafter.

According to the embodiment shown in FIG. 4 the container 2 is opened towards the bottom and only extends with its lower edge 12*a* into the oil layer 1. Near to its uppermost location or apex 12*b* there opens the vent line or conduit 13 containing the check or nonreturn valve 14; furthermore, in the neighborhood of the apex location 12*b* of the container 12 there is arranged the suction line or conduit 15 which is equipped with a suitable shut-off element 16, typically for instance a shut-off valve.

At the start of the conveying operation the container 12 is filled with water, the shut-off element 16 is closed. Due to the fact that the water in the container strives to flow downwardly there prevails a suction action by means of which the oil floating upon the surface of the water level flows towards the container 12. Within the confines thereof the oil ascends in the form of droplets 17, as the same has been shown in the drawing, and collects above the water.

When the container 12 has been filled with oil then such oil is withdrawn through the agency of the suction conduit or line 15, and water ascends within the container 12, whereby of course oil is also entrained which, however, immediately again is separated out above the water. As soon as the container is again filled with water there again begins with the complete intensity the renewed conveying operation of the oil to the higher level, and which has already begun during the withdrawal of the oil. The withdrawal of the oil out of the container can occur in this way depending upon requirements, i.e. at periodic intervals, but also it can however occur continuously.

Furthermore, it is to be mentioned that the suction conduit or line is not absolutely required. It would be also conceivable to close the open surface of the container 12 which confronts the water in any appropriate manner as soon as the container has been filled with oil and then to transport such away.

In order to be able to readily recognize the extent to which the container 12 has already been filled with oil there can be advantageously provided a filling level indicator 18. However, such level indicator can equally be replaced by any other indicating device suitable for this purpose, for instance, by a liquid feeler which responds to the different refractivity of water and oil.

If the water surface is not dead-smooth then it can happen that air bubbles will enter the container and ascend therein. The air cushion which thus forms as a practical matter does not appreciably impair the conveying action, yet it does reduce the capacity of the container. Also in this case the filling level indicator 18 or a float can be advantageously employed.

All of the indicator devices which are used serve the purpose of delivering a visual indication, an optical or acoustical signal, so that thereafter there can be undertaken the required operating measures. A number of devices are however also capable of automatically triggering an operation, for instance the switching-in or regulation of the sucking-away of the oil, the actuation of an air pump for venting the container and so forth.

For the preparatory positioning of the heavier liquid at the higher level in the case of a container which opens towards the bottom there are particularly available two possiblities. One such possibility resides in the fact that the container is completely immersed in the water. The air contained therein thus escapes through the vent line or conduit 13. Then the full container is raised —the check valve 14 prevents the in-flow of air through the vent line— until its lower edge is located just below the water level or just at such elevation. In the case of a very quiet surface the edge 12*a* of the container 12 can in fact even be raised somewhat above the water level; the cohesion forces of the water prevent a flowing out of the same, the connection of the container contents with the surrounding water remains intact and the sucking-up of the oil into the container is facilitated, this being of particular value in the case of very thin oil films or layers. As soon as the container has been sufficiently raised in order to free a flow path for the oil then the conveying action is initiated.

The second possibility resides in arranging the container 12 in such a way that only its lower edge 12*a* immerses into the water. By means of the vent line 13 the air is sucked-off, and the water ascends into the confines of the container. If the oil layer upon the water is thick enough in order to be able to flow into the container beneath its edge, then there are provided the requisite flow paths for the oil. If this is not the case then the container must additionally be raised somewhat, as has been previously described.

If the container is raised to such an elevation that its lower edge is located just at the height of the water level or in fact even somewhat higher in elevation, then with the described method it is possible to even completely suck-off in a positive manner thin oil films and to collect the same in the container. This operation is further assisted if at least the lower edge of the container is fabricated from a material having a higher wetting power for the oil than for the water.

A further exemplary embodiment of a container opening towards the bottom has been portrayed in FIGS. 5 and 6. In this case the container 12 is mounted upon a ship 19 and extends almost over the entire width thereof. Extensions 20 of the side walls 20*a* of the ship 19 extend to both sides into the water and owing to the continuous movement of the ship 19 in the water such cuts a strip of oil out of the water and which oil is floating upon the water, this oil then flowing in the direction of the arrow into the interior of the ship 19. This inflowing oil is guided by the guide surfaces 21 which simultaneously serve for quietening the flow when the water surface is moved. Further means for carrying out such quietening action, for instance deflection elements or the like can be provided internally of the ship 19. The oil arrives in the compartment 22 and then in the container 12 in which it is conveyed to the higher level as previously described above. In the compartment or space 23 there is located water which has been practically totally cleaned and which flows-off towards the rear. In this way, especially when utilizing a number of ships which travel in a staggered formation, it is possible to free larger water surfaces in a positive manner from an oil covering or slick.

The described embodiments of apparatus can be used in all instances where it is required to convey a liquid to a higher level and there is available a heavier liquid. This could be for instance so in the case of a drill hole or well wherein the underground water has been contaminated by escaping oil, also in the case of an open water surface which is covered by an oil layer or an oil film, or in the chemical industry, but in the last-mentioned environment of use care must be taken to insure that both liquids do not react with one another, also they should not admix with one another or at least only with extreme difficulty. Apart from these limitations the fields of application of the invention are practically without limits.

While there is shown and described present preferred embodiments of the invention, it is to be distinctly understood that the invention is not limited thereto, but may be otherwise variously embodied and practiced within the scope of the following claims.

Accordingly, what is claimed is:

1. A method for cleaning oil spills from the surface of a body of water comprising the steps of:

providing a container of liquid having a greater specific gravity than the specific gravity of the spilled oil, said container having at least one flow path therethrough;

positioning said container at a location relative to the surface of the body of water such that at least a portion of the greater specific gravity liquid therein is at a greater elevation than the elevation of the surface of the oil;

communicating, via said flow path, the liquid in said container with the surface of the oil; and conveying, in substantially countercurrent flow relation through said flow path, the liquid in said container toward a lower elevation and the oil toward a higher elevation within said container by utilization of the different specific gravities of the liquid and oil.

2. The method as defined in claim 1, wherein said container is initially empty of liquid and has a downwardly open lower edge and further including the steps of providing both liquids initially at the same level, and wherein, for positionally preparing the heavier liquid at the higher level, arranging said container such that at least its lower edge immerses into the heavier liquid, withdrawing air which is present in the container to thereby bring about the in-flow of the heavier liquid into the container.

3. The method as defined in claim 2, wherein the container immerses into the heavier liquid and air within the container is vented, whereafter the container filled wth the heavier liquid is elevationally raised to such an extent until its lower edge is approximately located at the height of the lower level.

4. The method as defined in claim 2, including the step of sucking-off the air present in the container.

5. The method as defined in claim 1, wherein the heavier liquid is water and the lighter liquid is an organic liquid, the heavier liquid serving to convey the organic liquid.

* * * * *